US008028940B2

(12) United States Patent
Kelly et al.

(10) Patent No.: US 8,028,940 B2
(45) Date of Patent: Oct. 4, 2011

(54) RESIDENTIAL WASTE VOLUME REDUCTION ARRANGEMENTS

(76) Inventors: Michael Kelly, Austin, TX (US); Allison Kelly, Austin, TX (US)

( * ) Notice: Subject to any disclaimer, the term of this patent is extended or adjusted under 35 U.S.C. 154(b) by 154 days.

(21) Appl. No.: 12/313,363

(22) Filed: Nov. 19, 2008

(65) Prior Publication Data

US 2009/0127361 A1 May 21, 2009

Related U.S. Application Data

(60) Provisional application No. 60/988,860, filed on Nov. 19, 2007.

(51) Int. Cl.
*B02C 25/00* (2006.01)

(52) U.S. Cl. ..... 241/36; 241/100

(58) Field of Classification Search ..... 241/100, 241/36, 236, DIG. 37
See application file for complete search history.

(56) References Cited

U.S. PATENT DOCUMENTS 4,143,823 A * 3/1979 Judson, Jr. ..... 241/73
4,714,203 A * 12/1987 Williams ..... 241/36

* cited by examiner

*Primary Examiner* — Mark Rosenbaum
(74) *Attorney, Agent, or Firm* — Alan Carlson

(57) ABSTRACT

The disclosed trash comminution apparatus (TCA) is a device designed to work in conjunction with existing residential trash receptacles utilized by both municipal and private trash collection services. The TCA can pulverize, grind and shred most residential trash items into small pieces, while allowing non-shreddable material to be disposed of as well. In some embodiments, the TCA can be installed on the top of a commonly utilized trash receptacle. To install the TCA on a common receptacle, the hinged top of the receptacle can be removed. A rectangular opening can be cut near the top, on the back side of the receptacle. The TCA can then fit directly inside the top lip of the receptacle and can be bolted into the sides of the receptacle with a reinforcing metal band on both the interior and exterior of the lip of the receptacle. An electrical connection box with a three-prong electrical plug can be installed into the rectangular. The TCA can have a metal lid and a latch to latch the lid to the receptacle. When the lid is closed a safety switch can allow comminution to begin.

14 Claims, 6 Drawing Sheets

RESIDENTIAL WASTE VOLUME REDUCTION ARRANGEMENTS

CROSS-REFERENCE TO RELATED APPLICATIONS

This application claims priority to an application filed in the U.S. provisional patent application No. 60/988,860 entitled Residential and Commercial Trash Shredder, filed on Nov. 19, 2007.

TECHNICAL FIELD

This disclosure relates generally to the comminution of household waste and, more particularly, to reducing residential waste volume at a residence prior to pick up by a trash collection service.

BACKGROUND

There are approximately 120 million residential households in the US. There are an estimated 100 million commercial trash receptacles around the country, which includes apartments, offices, and retail centers, where much of the waste thrown in such receptacles is similar to residential waste. Most trash items such as cardboard boxes, gallon milk jugs and glass receptacles are bulky and take up a large amount of space with most of this space being simply air. This causes trash receptacles to fill up quickly, requiring weekly collection. The trucks utilized to collect the trash can only handle so much volume and often the trucks must return to the landfill many times per day. Upon arrival at the landfill, additional machinery is needed to compact the trash to reduce the space consumed by such trash, but the trash still occupies more space than necessary. Large chunks of trash impede the decomposition process causing energy generation to be much slower and less efficient than it could be.

SUMMARY

The disclosed trash comminution apparatus (TCA) is a device designed to work in conjunction with existing residential trash receptacles utilized by both municipal and private trash collection services. The TCA can pulverize, grind and shred most residential trash items into small pieces, while allowing non-shreddable material to be disposed of as well. In some embodiments, the TCA can be installed on the top of a commonly utilized trash receptacle. To install the TCA on a common receptacle, the hinged top of the receptacle can be removed. A rectangular opening can be cut near the top, on the back side of the receptacle. The TCA can then fit directly inside the top lip of the receptacle and can be bolted into the sides of the receptacle with a reinforcing metal band on both the interior and exterior of the lip of the receptacle. An electrical connection box with a three-prong electrical plug can be installed into the rectangular. The TCA can have a metal lid and a latch to latch the lid to the receptacle. When the lid is closed a safety switch can allow comminution to begin.

When a user's trash bin becomes full, the user can lift out the plastic trash bag liner and carry the bag to the TCA, lift the lid and deposit the bag in the TCA. The lid can be closed and locked and the waste can be broken into small pieces by the TCA as the user walks away. After comminution, a disinfectant dispersion system can disperse a bleach solution on the shredded trash to kill insects and to keep the shredded trash from emitting an undesirable odor. The lid lock can have a catch that acts as a safety mechanism to insure that the lid is completely secure and all items (and no fingers) are present near the grinding components prior to shredding.

In some embodiments a system for reducing the volume of residential waste is disclosed. The system can include a frame and a hingable lid attached to the frame. The lid can have a latch to secure the lid to the frame. The system can also include a sensor coupled to the frame to detect if the lid is in a closed and/or secured position. A motor can rotate a shaft in a chamber, and a member on the shaft such as a knife or a hammer can engage the waste and move it towards the cage and fragment the waste in the chamber.

The system can also include a trash volume reduction chamber connected to the frame where the chamber has a surface forming at least a portion of a cage, the cage having orifices to allow trash particles of a predetermined size to fall out of the reduction chamber. In some embodiments the system can include an agent dispersal system to disperse an agent on the fragmented trash to control odors resulting from trash decomposition. A bottom opening of the system can have flexible flaps to guide the fragmented waste into the mobile curb-side receptacle. The system can also have adjustable legs secured to the frame to hold the reduction chamber above the mobile curb-side receptacle. In some embodiments the system can include a control system to prevent activation of the motor if the lid is un-secured.

In some embodiments a sensor can be located proximate to the chamber to detect the presence of material in the chamber and can facilitate activation of the motor if the material is detected. Another sensor can detect that the hingable lid is secured to the chamber. The system can also include a set of jaws for compressing and crushing the waste. In some embodiments one jaw can be fixed and another jaw can rotate about a hinge or joint. The moving jaw can be driven by a pitman arm or a cam to achieve a mechanical advantage.

In some embodiments, the jaws can have a gap at the bottom and as the trash is compacted to a predetermined dimension the trash can fall into a second stage of the comminution system. The second stage can include a dual shaft knife type hammer mill or shredder where the shafts counter rotate. In the hammer mill embodiment a hub can be coupled to the shaft and hammers can pivot about the hub. In some embodiments a surface can be provided where the surface has slots and as the hammers rotate they can pass through the slots In some embodiments a method of waste disposal is disclosed. The method can include depositing household waste into a waste volume reduction mechanism where the mechanism is mountable above a mobile residential curb-side receptacle. The lid can be secured and the system can detect that the lid is properly secured. If the lid is secured that motor can start and the motor can turn a crusher and/or a rotary grinder. The crusher/grinder can fragment the household waste and a cage or screening mechanism can allow sub-particles of trash that are less than a predetermined size to pass out of the waste volume reduction mechanism.

An agent can be dispersed into the receptacle to keep odors and insects under control. The method can also include detecting an overload in the cutting mechanism and interrupting the volume reduction process. A sensor can detect an overload of the grinding system and in response to such detection the system can auto-reverse the rotational or linear direction of the crushing or fragmenting components. In yet another embodiment a residential trash volume reduction system can include a first volume reduction stage that has a set of jaws configured to move in relationship to another. The jaws can comminute residential waste and reduce the volume of the trash to a predetermined dimension and when the trash is reduced to such a dimension the trash can move beyond the jaws.

In still another embodiment, a volume reduction system is disclosed that has a first jaw crushing stage and a second pulverizing stage that utilizes knives. The second volume reduction stage can accept the trash in a predetermined dimension from the first crushing stage and the second stage can perforate the trash, segmenting particles of the trash. The second volume reduction system can have a cage to retain particles of a predetermined size and to allow particles of a size that is smaller than the predetermined size to fall into a receptacle. Accordingly, the particles that are retained are continually bombarded until they are small enough to escape the cage.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION

Figure 1:
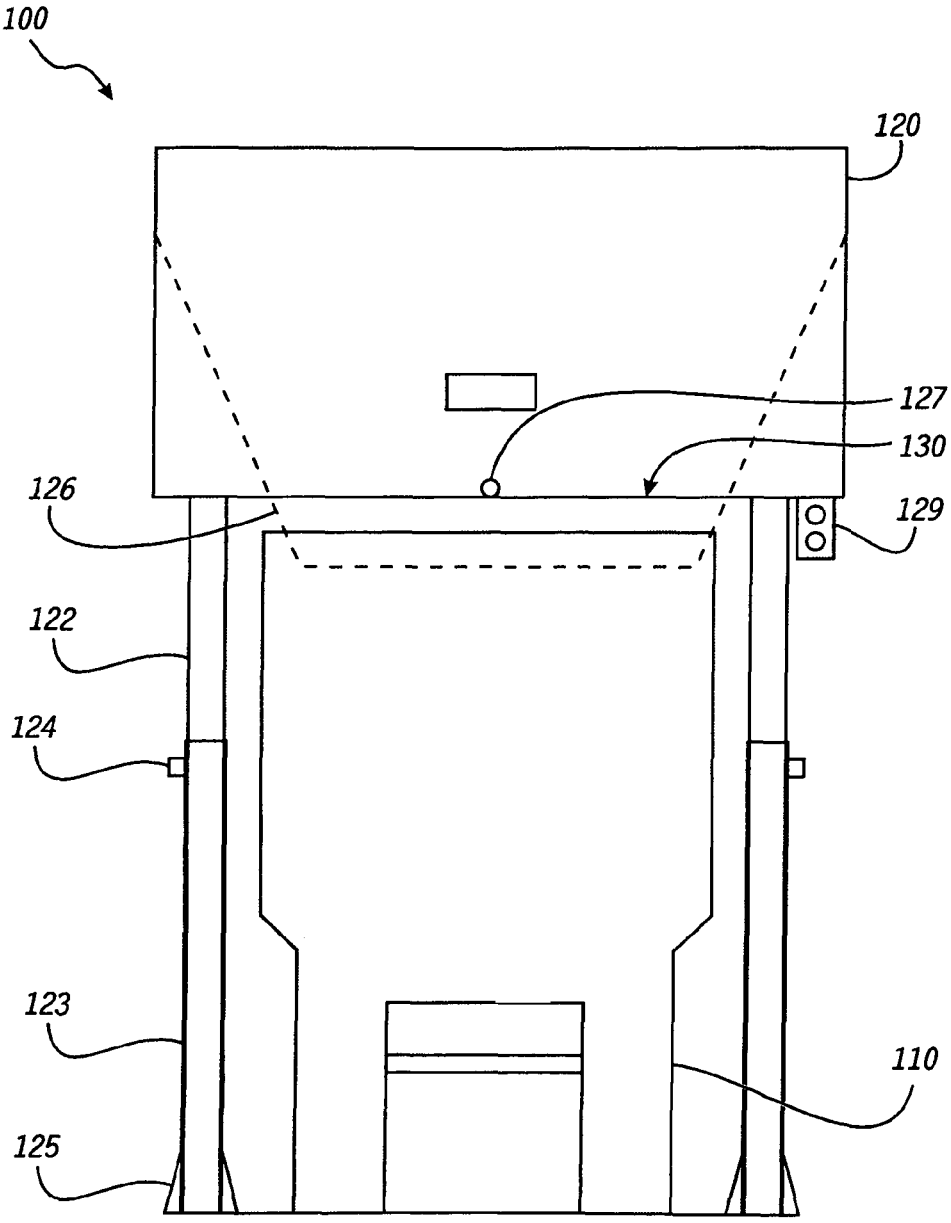
FIG. 1 illustrates a trash comminution apparatus (TCA) system.

The following is a detailed description of novel embodiments depicted in the accompanying drawings. The embodiments are in such detail as to clearly communicate the subject matter. However, the amount of detail offered is not intended to limit anticipated variations of the described embodiments; but on the contrary, the claims and detailed description are to cover all modifications, equivalents, and alternatives falling within the spirit and scope of the present teachings as defined by the appended claims. The detailed descriptions below are designed to make such embodiments understandable to a person having ordinary skill in the art. While specific embodiments will be described below with reference to adapters, components, circuits or logic configurations, those of skill in the art will realize that embodiments of the present disclosure may advantageously be implemented with other components and configurations.

Reducing the size of individual components of residential trash prior to the trash being picked up and hauled would be very beneficial to society. For example, having residents comminute their trash in a receptacle having an anti-odor mechanism trash could allow for monthly or bi-monthly curbside collection as opposed to the current collection systems that require trash to be collected weekly or twice weekly. Such reduced collection frequency would make trash disposal much more economical. Comminution is defined generally as any process by which larger particles are reduced to smaller particles. It can be appreciated that comminuted trash at the residential level can allow for fewer trash collections thereby substantially reducing the cost associated with collection because less trucks would be needed, less fuel would be consumed less maintenance would be required and less labor would be required. It has been predicted that comminution at the residential level could reduce collection system costs by one half. Yet further, municipalities and landfills would reap substantial benefits. For example, disposal trucks might be able to expand their territory requiring fewer trucks and fewer workers to cover the same geographical area.

In addition, the machinery currently utilized to reduce the size of non-shredded trash and the operators of such equipment could be virtually eliminated if properly ground waste was entering the landfill or entering a recycling system adjacent to the landfill. In fact, the landfill may only need a small loader or bulldozer to spread the shredded trash. Reducing the volume of the trash entering the landfill will substantially increase the lifespan and capacity of the landfill. Further, it is well known that speed of decomposition or pyrolysis of the ground waste is substantially faster than the speed of decomposition of un-ground trash because energy generation from bacteria is much more rapid and efficient.

By shredding trash into to smaller components at each residence, trash separation and recycling at a landfill becomes economically feasible for smaller municipalities. Thus, a city could provide a citizen with a residential waste volume reduction apparatus and could increase the waste collection bill to the citizen to pay for the grinder over time and then the city could efficiently implement a recycling system because no large grinders would be required of the city to recycle at their landfill.

Simple recycling for a municipality can include dumping shredded trash into a reservoir of water, whereby the water can separate articles that float from articles that sink. For example, many recyclables such as metal, glass, dirt, rocks, can be put back into the economy if they can be sorted when retrieved from the bottom of the reservoir. Generally things that float such as paper, Styrofoam, plastic, light organics, wood, etc., are recyclable or burnable. Thus, residential based grinding could make it more economical and practical to recycle a much larger percentage of household trash that comes into the landfill. It can be appreciated that there are distinct advantages to reducing the volume of household trash remotely to the landfill and prior to collection by a municipal or commercial trash collection operation Generally, the disclosed trash comminution apparatus (TCA) can comminute a conglomeration of items found in household waste. In accordance with the disclosed embodiments, comminution can be achieved by crushing or pulverizing the waste using an impact mechanism or by grinding using a rotating blade or by a combination thereof. Thus in some embodiments, both crushing and grinding can be achieved and in some embodiments, two stage comminution can be implemented. For example, initially the trash can be crushed to break all of the glass bottles into smaller particles and then the crushed trash can be ground into yet smaller particles. The trash comminution system can have a first stage that is a jaw crusher/compactor and a second stage that is a shredder grinder. Generally, first impact stage can reduce large glass, cardboard, aluminum and plastic containers into smaller yet relatively coarse chunks and then in the second stage rotating blades can grind the coarse chunks into smaller finer particles.

Referring to FIG. 1, a trash comminution apparatus (TCA) system 100 is illustrated. The system 100 can utilize a commercially available and popular style of trash can, container or as utilized generically herein, a receptacle 110. Receptacle 110 can be a wheeled curb-side receptacle designed to be moved by a single individual and emptied by a garbage collection truck possibly with mechanical assistance. The system 100 could be adapted such that it can be located above nearly any receptacle 110. Enclosure 120 can be mounted on top of four (4) rigid metal members 122. The members 122 could be embodied as 1½ inch diameter tubes that are inserted into four (4) metal 1¾ inch receiving tubes 123. In some embodiments, the receiving tubes 123 and members 122 can contain holes that line up and when the length of the legs is acceptable, an adjustment pin 124 can be inserted through the tubes 123 and members 122 to adjust the height of the system 100. In some embodiments, the system can be lowered to 27 inches off of the ground and can be adjusted to at least 45 inches off of the ground to accommodate receptacles 110 of different heights. The bottom of each tube 123 can have stabilizing fin 125 to stabilize the frame by controlling lateral movement of the entire structure. Four (4) rubber flaps 126 can be mounted underneath the enclosure 120 at the edges of the shredding mechanism 130. The rubber flaps 126 can guide the shredded trash into the receptacle 110 and to reduce the gap between the bottom of enclosure 120 and the top of receptacle 110. The lid of the enclosure 120 can be opened by deactivating latch 127, grasping the handle and lifting the lid (not shown).

When trash is placed inside enclosure 120, the enclosure lid (not shown) may be re-secured utilizing latch 127. The system 100 can have a sensor or a safety feature connected to the lid or the latch such that the system 100 will not activate or operate unless the latch has secured the lid to the enclosure 120. With the lid closed and secured, the shredding mechanism 130 can be activated by activating a shred button or placing a forward/reverse switch 129 in the forward position. The shredding mechanism 130 can shred the trash and as the trash is reduced to smaller particles the smaller shredded particles of trash can fall through a screen into the receptacle 110. In the event trash particles get caught in the mechanism 130, the switch 129 can be placed in the reverse position thereby reversing the direction of the mechanism to clear the obstruction.

Once the device is installed and the receptacle has been properly positioned under the shredding mechanism, it is plugged into the nearest electrical plug. A person would bring their trash to the receptacle, open up the enclosure lid 120 and place the trash on top of the shredding mechanism 130. The enclosure lid 120 would then be closed, the enclosure clasp 127 would be properly secured and the forward button on the forward/reverse switch 129 would be pressed. The shredding mechanism 130 would then shred the trash into small chunks that would then fall into the body of the trash can 110. The device is designed to shred most trash, however, it will not shred tempered steel, car batteries, paint cans, et al. If the device encounters resistance that exceeds the pre-set amount, the cut-off control will stop the motor and an alarm will sound. The operator would then have to clear the obstruction and could reverse the motor if necessary to remove it, before the device would operate again. However, if a user needs to throw something away that cannot be shredded, they can easily pull out the trash can 110, deposit the item into the trash can and then re-position the can under the shredding mechanism.

Figure 2:
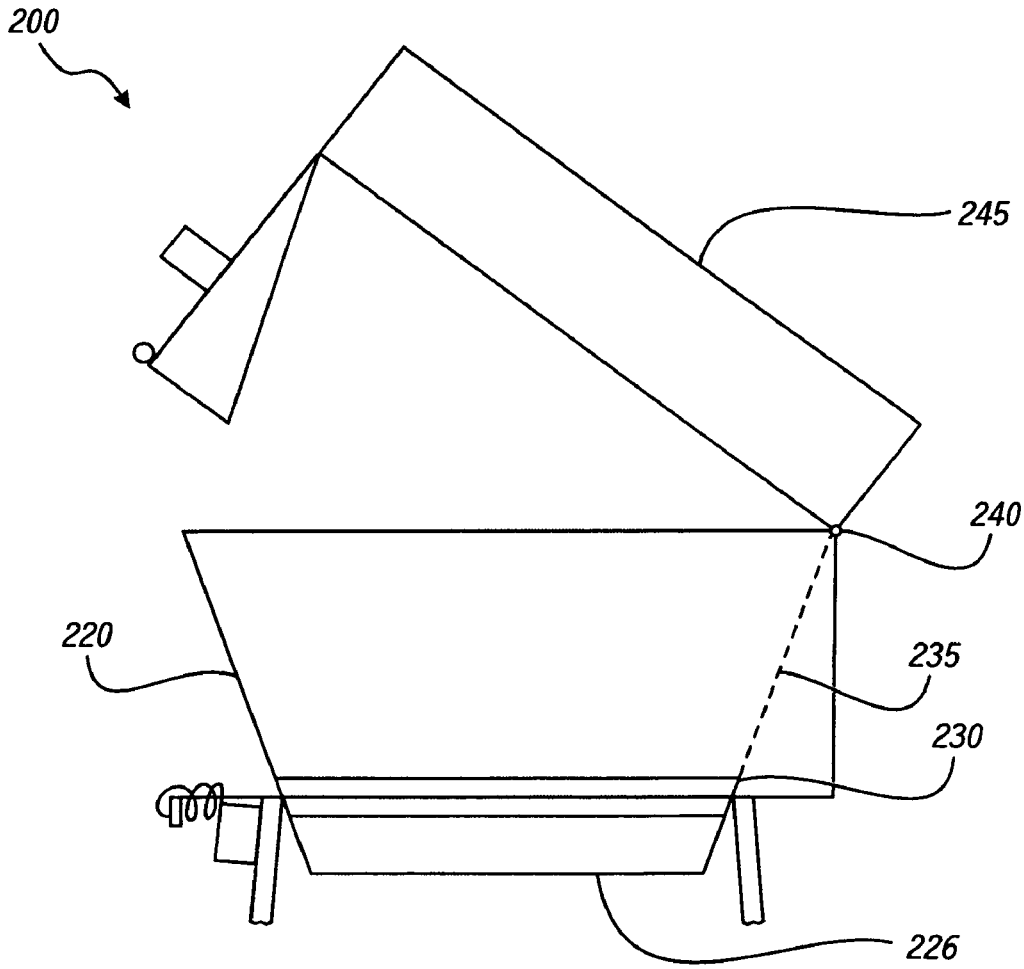
FIG. 2 depicts a side view of the TCA system disclosed in FIG. 1.

This shredding mechanism 130 can be installed and operate in conjunction with existing trash receptacles provided by both municipal and private (i.e. Waste Management, BFI, etc.) trash collection services. The receptacle 110 can be round, square or a combination thereof. In some embodiments, the shredding mechanism 130 can be hinged such that is can be lifted to place waste in the receptacle thereby bypassing the shredding mechanism. Thus, the system 100 can shred most trash into small pieces, while also allowing non-shreddable material to be disposed of as well FIG. 2 is a side view of the embodiment disclosed in FIG. 1. As stated earlier, the lid 245 can be raised to place trash into the enclosure 220 and the lid 245 can pivot in relation to the enclosure via a hinge 240. In some embodiments, the hinge 240 can be a piano hinge. When the lid 245 is in the up position the enclosure 220 can be open on the top side. With the lid 245 in the up position, trash can be placed in the enclosure and gravity, with the assistance of the hopper guides 235 which form a funnel, can guide the trash into the shredding mechanism 230. The frame can include an adjustable stand having adjustable legs. The enclosure 220 can be mounted on the stand and the stand can be supported by one or more horizontal support braces (not shown). The rubber flaps 226 can be mounted on all four sides, and can guide the shredded trash into the receptacle (110 as shown on FIG. 1).

Figure 3:
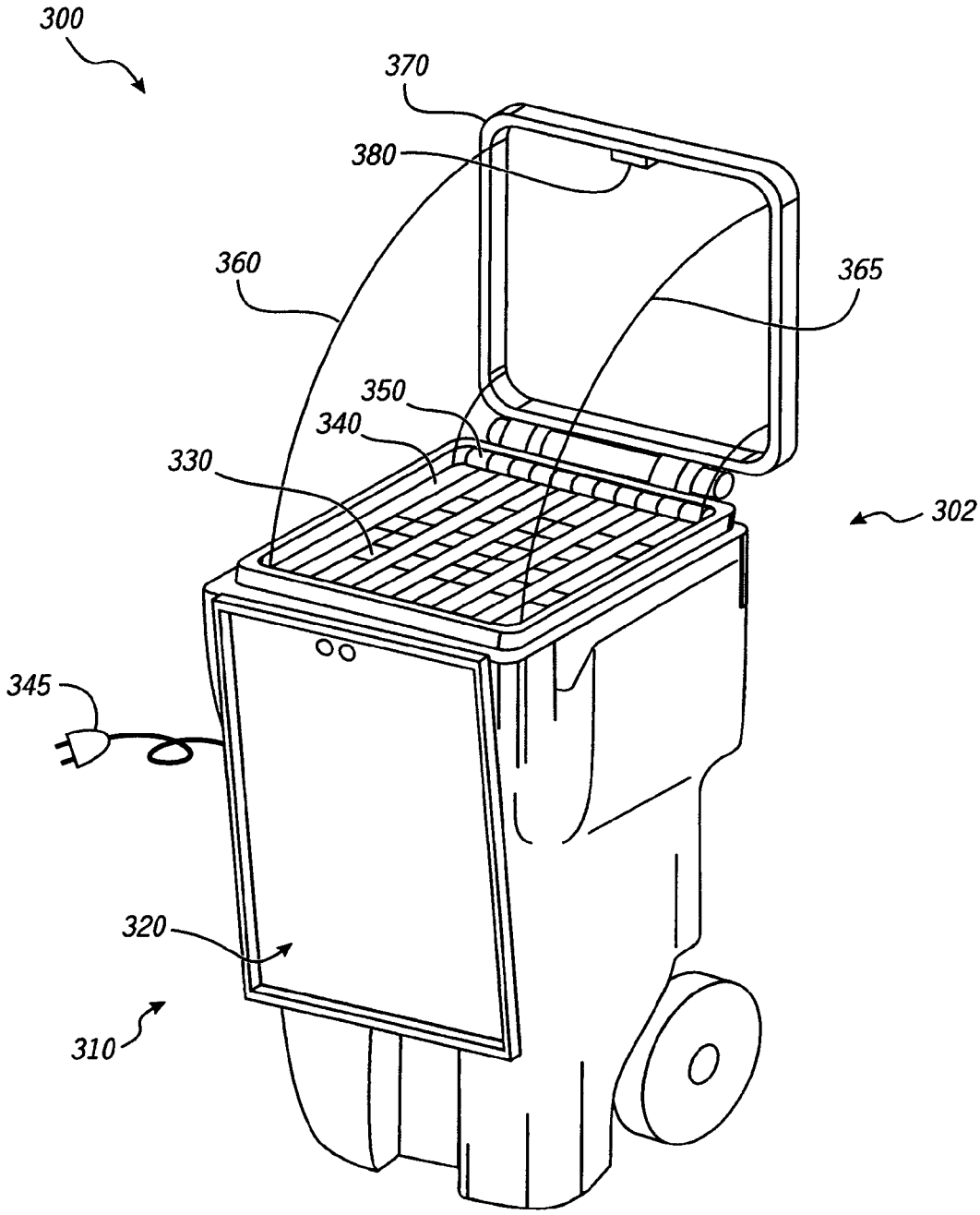
FIG. 3 illustrates another embodiment of a TCA system.

Referring to FIG. 3, some arrangements for a residential waste volume reduction are illustrated 300. The arrangement 300 can include a trash receptacle 310 and a trash comminution apparatus (TCA) 302. Trash receptacle 310 can be a curb-side receptacle designed to be emptied by a trash collection service. In some embodiments, the TCA 302 can be adapted to a variety of popular receptacles and the receptacle illustrated is merely illustrative and not limiting. Shredding mechanism 330 can be attached by hinge 350 seated near the top opening of trash receptacle 310 receives trash for shredding. Control box 340 connected to shredding mechanism 330 provides power through AC plug 345 to shredding mechanism 330 and also provides shredding controls (not shown) such as speed control, forward and reverse controls, on/off controls, and so forth. AC plug 345 may be connected to a source of electrical power (not shown). Shredding mechanism 330 may be mounted to trash receptacle 310 with hinge 350. The frame can be sturdy such that the frame creates a secure area or protective cage in which the shredding mechanism 330 can shred the trash, where no trash or system components can fly out and injure an individual. A shock absorber (not shown) may be attached to the shredding mechanism 330.

Shredding mechanism 330 may have one set of axles containing large, tearing teeth with gears on one end of each axle, one set of axles containing smaller, cutting teeth with gears on one end of each axle, one high-torque, low-speed, reversible electric motor with a gear attachment, and one control box 340 with capabilities for motor control (forward/reverse), weight sensor, motor cut-off, annunciator, and lid attachment sensor.

The reduced trash can be deposited into a trash collection truck wherein the trash collection truck lifts the trash receptacle with a lifting arm. Shredding mechanism 330 pivots open on hinge and the trash can lid 370 also pivots open so that shredded trash may be deposited into the trash collection truck. A shock absorber (not shown) mounted to trash receptacle under and connected to shredding mechanism helps keep shredding mechanism 330 from banging back into place when trash receptacle 310 is returned to the ground after the shredded trash has been deposited.

Once the device is installed in the receptacle, it is plugged into the nearest electrical plug. The user would bring their trash to the receptacle, open up the lid 370 and place the trash on top of the shredding mechanism 330. The front plate 320 would be slid up and connected to the lid 370. The weight sensor in the control box 340 and the connection 380 on the lid being secured would complete the electrical circuit and engage the motor. The shredding mechanism 330 would then shred the trash into large chunks which fall down on the next level, where they are shredded into smaller chunks. The device is designed to shred most trash, however, it will not shred tempered steel, car batteries, paint cans, etc. If the device encounters resistance that exceeds the pre-set amount, the cut-off control will stop the motor and an alarm will sound. The user would then have to clear the obstruction and could reverse the motor if necessary to remove it, before the device would operate again. However, if a user needs to throw something away that cannot be shredded, they can easily pick up the shredding mechanism 330 itself and deposit the item underneath it into the receptacle.

When collection time comes, the receptacle is unplugged and moved to the collection point. When the receptacle is lifted by the collection truck, at the apex of the arc where the lid starts to open, the shredding mechanism 330 would also lift off the angle iron, secured at the rear with the hinge. The shock absorbers control and limit the opening, such that the force of the opening and the return would not damage either the device or the receptacle. Once all the trash has been removed, the receptacle can then be moved back to the original location and reattached to the power source.

Figure 4:
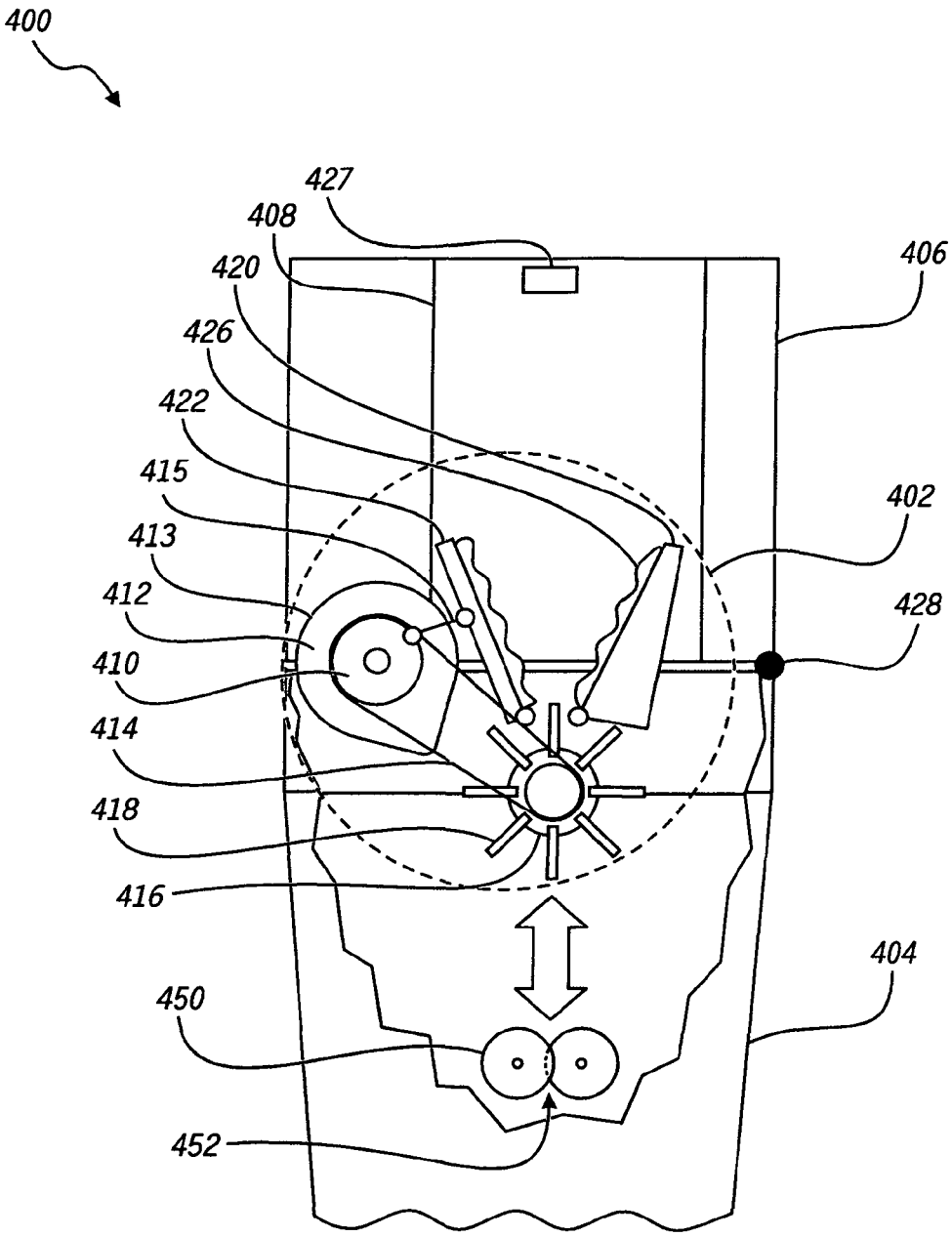
FIG. 4 illustrates another embodiment of a TCA system.

Referring to FIG. 4, an impact crusher system 400 is disclosed. The system 400 can include a receptacle 404, the TCA 402, jaws 420 and 422, a lid 406, a motor 410, a cam 412, a flywheel 413, a belt 414, a pitman arm 415, a hub 416, and hammers 418. The lid 406 can have a raised portion 408 to accommodate the jaws 420 and 422. The jaws 420 and 422 can be two hardened steel surfaces. In some embodiments, the surfaces can be textured, rough, waffled or complementary surfaces (where a protrusion of one surface enters a recess in another surface). One jaw 420 can have a surface (an anvil) that can be stationary and the other surface (a shoe) can move in relation to the other jaw 422 (the anvil). In some embodiments, both impact surfaces can move.

The jaws 420 and 422 or the crusher portion of the TCA 402 can utilize an inertial device such as flywheel 413 and a cam 412 or a pitman arm 415 to provide a mechanical advantage thereby converting a rotary force to a linear type force provided by the jaws 420 and 422. Inertia from the weighted flywheel 413 can be utilized to provide extreme forces required to crush the waste material. The cam 412 or alternately, the pitman arm 415 can move in relation to jaw 422 via an eccentric motion that causes a closing of the gap between the jaws 420 and 422. The force provided by the motor 410, flywheel 413, cam 412, or pitman arm 415, and the jaws 420 and 422 to the waste can be greater than the molecular bond of particles in the waste thereby making larger pieces smaller. The jaws 420 and 422 generally accept waste material between two parallel or tangent solid surfaces, and apply a force to both sides of the waste as the surfaces come together thereby generating enough energy within the material being crushed so that adjacent molecules fracture or separate or alternately change alignment in relation to each other causing deformation.

In some embodiments, jaws 420 and 422 can be configured in a "V" shape where with maximum separation the distance or dimension between the top edge of the jaws 420 and 422 is maximum and the bottom edge of the jaws is relatively fixed as the dimension between the jaws 420 and 422 gets smaller at the bottom. In some embodiments, the distance between the bottom edges of the jaws 420 and 422 can be adjusted by a user based on the type of waste generated by the user. In operation, waste particles (usually in a plastic garbage bag) can be placed between the jaws 420 and 422 and the lid 406 can be put down and latched with latch 427. Sensor 426 can sense material between the jaws 420 and 422 and sensor 428 can sense that the lid 406 is closed and when material exists between the jaws and the lid 406 is fastened, the motor can automatically start and the comminution process can begin automatically.

As the motor 410 rotates, the cam 412 can rotate and force the top of jaw 422 closer to the top of jaw 420, crushing the waste. As the waste between the jaws gets smaller, gravity can pull on the waste and the waste can fall downward toward the bottom of jaws 420 and 422. It can be appreciated that the jaws 420 and 422 get closer at the bottom and thus the waste that moves lower will be smaller. In some embodiments, lower power can be utilized because the closest the jaws 420 and 422 may get is several inches. This can also be user adjustable.

As the motor 410 rotates, the hub 416 can rotate via the belt 414 and pulleys or a chain and sprocket. As the hub 416 rotates increasingly faster, centrifugal force can swing the hammers 418 out radially to the hub 416 and the hammers 418 can impact the waste. The jaws 420 and 422 can have slots acting as a screen, a grater, and cutting edges. In some embodiments, the hammers 418 and slots can provide a guillotine action to break, bust, or pulverize the narrow section of waste that has fallen into the narrowest portion of the jaws 420 and 422. The motor 410, hub 416, and hammers 418 can act as a hammer mill and as the particles get small enough to get through the slots or between the hub 416 and the bottom of the jaws 420 and 422 the particles can fall into the receptacle 404.

Accordingly, the jaws 420 and 422 of the TCA 402 can reduce large compressible objects such as aluminum, glass, plastic, or cardboard containers to a smaller volume, or reduce such objects into smaller pieces. As the smaller pieces fall within range of the swinging hammers 418, the smaller pieces can be shredded. The movement of the jaw can be quite small, since complete crushing does not need to be accomplished in one stroke.

In some embodiments, the crushing portion can be a gyratory crusher, which is similar in concept to the disclosed jaw crusher however, one jaw surface can have a concave surface and the other jaw can be embodied as a conical head where the distance between the surfaces becomes smaller and smaller from top to bottom. The inner cone/conical head can have a slight circular movement but may not rotate. The movement of the cone can be eccentric and as with the jaw crusher, the waste material can travel downward between the two surfaces (cone and concave surface) as the material becomes progressively smaller until the waste particles are small enough to fall out through a gap at the bottom edges of the surfaces.

The jaws 420 and 422 can act as an impact crusher or just a compactor depending on the speed of the jaw 422. Generally, higher speeds can cause an impact that uses an instantaneous impact force rather than pressure to crush the waste material. The material can be contained within a "virtual" cage or cage feature where the cage has orifices or perforations and the larger particles that cannot fit through the orifices eventually get hit by mechanism or flying debris and become small enough to move through the screen and fall into the receptacle. The virtual cage can be defined by a chamber that has the above described orifices that allow smaller matter to exit the cage. It can be appreciated that the cage is very strong such that even a mechanical malfunction where the shredder comes apart, the cage will contain the fragments caused by the malfunction. The cage can be considered a screen and the orifices or the screen can be included as slots in the jaws 420 and 422 where the hammers 418 operate in openings between the hub 416 and the bottom of the jaws 420 and 422 and the hammers 418. Other orifices could also be added at the bottom, end or side of the jaws 420 and 422 or between the jaws 420 and 422 and the hub 416, where the openings in the cage are of a desired size allowing the jaws 420 and 422 to pulverized material until the material is small enough to escape the cage. Thus, the size of the openings can dictate the size and shape of the shreds that the disclosed system produces. The first crusher stage could be a jaw crusher, a toggle crusher, a gyratory crusher, a cone crusher, a horizontal or a vertical shaft impactor or almost any type of impact crusher.

In some embodiments, the dimension at the bottom of the jaws 420 and 422 can reduce the size of the waste to a relatively thin strip, for example one inch by 20 inches. In these embodiments, the hub 416 and hammers 418 can be replaced by virtually any other type of shredder. For example, the hub 416 and hammers 418 could be replaced by a dual shaft shredder 450 having staggered cutters such that the cutters overlap in an overlap region 452. The double shaft shredder 450 can have counter rotating shafts where the rotational speeds of the shafts are different thus providing a grabbing and shredding action. The double shaft shredder can rotate at much lower speeds than the hammer mill embodiment providing specific advantages over the hub, hammer, or hammer mill embodiment. The dual shaft shredder 450 can operate as a strip cut, cross cut, confetti cut, particle cut, disintegrators, granulators, or pierce and tear shredder. In some embodiments, the dual shaft shredder 450 can utilize rotating knives to cut narrow strips from the compacted jaws. In some embodiments, the dual shaft shredder 450 can use two contra-rotating drums to cut rectangular, parallelogram, or diamond-shaped or lozenge shreds from the compacted material.

In some embodiments, the shredder 450 can perform as a particle-cut shredder cutting the waste into tiny square or circular pieces. The shredder 450 can act as a disintegrator and/or granulator that repeatedly cuts the waste at random until the particles are small enough to pass through a screen. The shredder 450 can operate as a pierce and tear shredder where the rotating blades pierce the trash and then tear it apart. Either way the shredder can grind waste material utilizing one or more rotating shafts where the shaft has cutting blades that grind the waste until it is small enough to fall through a screen. After the knives or cutting blades reduce the particle size a screen located inside the chamber can act as a filter not allowing the particles to pass into the receptacle until they are small enough. If the plastic pieces are too large, they are hit, cut, deformed, etc., until through attrition, the particles become small enough to get through the screen/filter.

The shredder 450 can also act as a grinding mill. For example the shredder can perform as a ball mill, a rod mill, semi-autogenous (SAG) mill, an autogenous mill, pebble mill, or as high-pressure grinding rollers. The shredder 450 can expose waste to mechanical forces that trench the structure of particles by overcoming of the interior bonding forces of individual pieces of waste. In other embodiments, cutter blades may not be necessary as high pressure grinding rollers with an uneven surface apply pressure to the particles causing the waste to fracture into finer particles. The two rollers can rotate in opposite directions, "nipping" and crushing material between them. In some embodiments, the shredder 450 can operate as an edge runner, having a circular pan with two or more heavy wheels known as mullers rotating within it wherein waste to be crushed can be moved underneath the wheels by a mechanical action.

Figure 5:
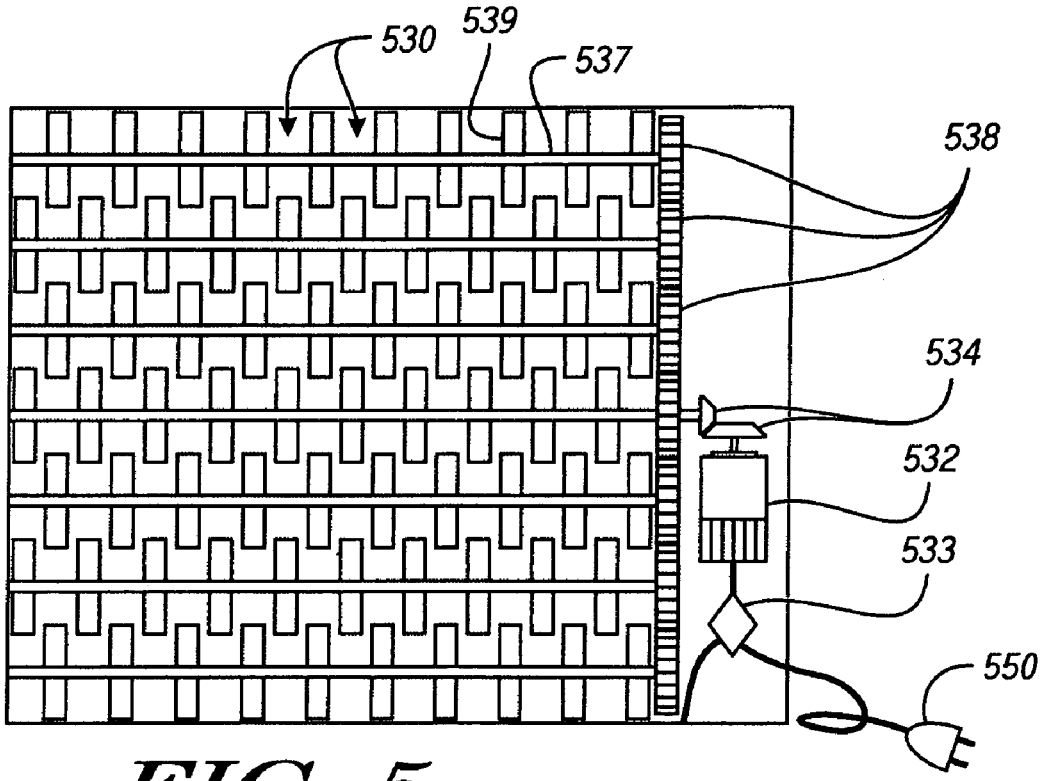
FIG. 5 depicts a top view of a trash shredding mechanism for a TCA system.

FIG. 5 is a top view of the shredder mechanism 530. As stated above, the shredding mechanism 530 can be driven by motor 532, which may use electrical power supplied from a conventional twenty amp 110 v outlet via power cord 550. In some embodiments, the motor 532 can be connected to 45 degree bevel gears 534 which may be attached to a primary axle 537. The rotational torque of the primary axel 537 can be distributed to non-primary axles by gears 538 which can be engage with each other. This engagement can provide an even distribution of torque across all axles and such torque can be transferred to the shredding teeth 539. The motor 532 can be controlled by a forward/reverse controller 533.

The shredding mechanism 530 itself may be comprised of two layers of teeth. The first layer will contain larger teeth that will shred the trash into fairly large chunks, which will fall through to the second layer of teeth, which will shred the trash into smaller chunks. The layers will be either 2 or 4 axles each, with gears at one end. The gears will connect to an electric motor. Specific embodiments may provide sensors to detect weight placed on the shredder on the first layer and the connection on the lid is secured, the motor will engage and shred the trash.

Figure 6A:
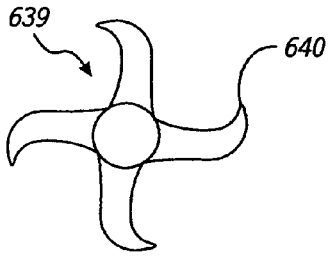
FIGS. 6A to 6E is a detailed illustration of various embodiments of a shredding teeth component for a TCA.
Figure 6B:
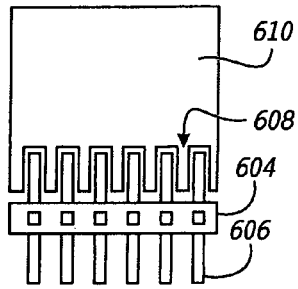

FIGS. 6A-6E illustrate different comminution mechanisms such as styles of cutters. FIGS. 6A, 6C, 6D and 6E are side views of cutters that could be fastened to the shaft or shafts shown in FIGS. 1-3, where FIG. 6B illustrates a cutting drum and a grate configuration.

FIG. 6A is a side view of a rotary cutter 639 having shredding teeth. Cutter 639 can have teeth 640 that can be hardened steel and can be sharpened. Referring to FIG. 6B a rotatable drum 604 with cutters or knives 606 possibly swinging knives are attached to the drum 604 and as the drum 604 rotates the cutters pass through slots 608 on surface 610. Thus, trash can be pinched between the knives 606 and the surface 610 and when knives fragment the trash into fragments that are small enough to fit through the slots 608 the trash can fall out of the shredder into a receptacle. Alternately described, the surface 610 can be a stationary surface and the surface 610 can form a plane and the knives 606 can pass through a plane of the stationary surface 610. In some embodiments, such as the one depicted by FIG. 4, the plane 610 can be a jaw such as jaws 420 and 422 in FIG. 4.

Figure 6C:
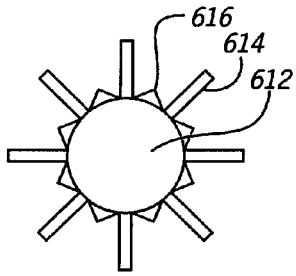
Figure 6D:
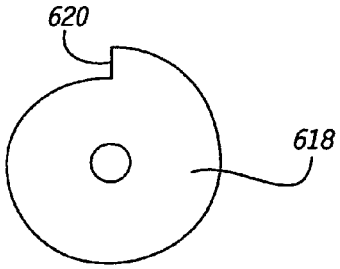
Figure 6E:
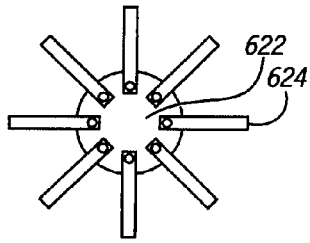

Referring to FIG. 6C a side view of a drum 612 such as drum 604 is illustrated. The drum 612 can have knives 614 and/or nodules 616 to cut grind and shred trash. Referring to FIG. 6D a cutting wheel 618 that can regulate the depth of cut is illustrated. The dimension of the tooth 620 can regulate how deep the cutter can cut into the trash, thereby providing regulation to the amount of jamming that can occur. The cutting wheel 618 could be utilized by the embodiments in FIGS. 1-4. FIG. 6E a drum or hub 622 is illustrated where swinging hammers 624 can be attached to the hub 622 and as the hub gets up to a specific rotational speed the hammer can project radially from the hub 622 (as shown) as the hammers 624 can achieve a significant tip speed and can pulverize and/or shred waste. It can be appreciated that if the hammers impact a material that is hard enough that it will not pulverize, then the hammer 624 can fold back on its hinge 624 allowing the hub to continue rotation such that the system will not jam.

In operation, a user can approach the receptacle with trash bag in hand, open the lid, where the two side plates rotate up, and with the lid open and a user can put trash bag into the TCA. The lid can be closed and a latch can secure the lid in a closed position and comminution can occur as the user walks away. In some embodiments, the shredding mechanism can include a motor, one or more screens, one or more shafts, teeth, hammers, an anvil, a shoe, a grater, bearing, pulleys, belts, etc. In some embodiments, two stage comminution can be achieved where the mechanism or teeth are different in each stage. In some embodiments, a first layer can utilize larger teeth that will shred the trash into fairly large chunks and, via gravity, the chunks can fall through to the second layer of teeth, which can shred the larger chunks of trash into smaller chunks. The layers or grinding teeth can be located on two or four shafts that rotate. The shafts can be connected to an electric motor via belts and pulleys or gears.

In some embodiments, sensors can detect the weight of the trash placed on top of the shredding mechanism and a signal from the sensor and a signal from the latch indicating that the lid is secured can activate the system and shredding can begin. The teeth or hammers can be strong enough to shred just about everything, with the exception of very hard materials such as thick steel, batteries, aerosol cans, and the like. If such hard waste is deposited into the TCA and the shredding mechanism locks up a sensor can detect such a situation and the cutters can automatically reverse and a warning light or audible alarm can be triggered.

The TCA can be hinged on the receptacle and when a user desires to bypass the TCA the user can release a latch and lift the front of the TCA and throw non-shreddable waste in the bottom of the receptacle. When a user must move the receptacle to the street prior to collection time, the power cord can be unplugged and the receptacle with the TCA can be moved or wheeled to the collection point at the street and the lid and the TCA can be unlatched.

When the truck collects the trash from the collection point, a mechanical arm can pick up the receptacle and turn it upside down, where gravity and the weight of the trash can force the TCA and the lid to swing open as the ground waste falls into the truck. Once all the ground trash falls out of the receptacle, the mechanical arm can return the receptacle to the ground. In some embodiments, the TCA can be secured at the rear hinge with one or more hydraulic shocks. The shocks can allow for a reasonably smooth, gentle opening process of the TCA. When the receptacle is returned to the ground, gravity can cause the TCA to lower back down into position in a controlled manner.

The TCA can be built from steel components and can be sturdy such that the TCA can withstand most impact without compromising the lifespan of the TCA. The side plates mentioned above can provide guides for the trash coming out to reduce the chance of any lightweight pieces floating away (i.e.—paper, Styrofoam, plastic) due to wind, etc. The side plates can also ensure that the ground trash will make it into a smaller opening in the truck. The front plate can be secured such that it does not drop down into the receptacle when the lid opens up.

This disclosure has been presented for purposes of illustration and description but is not intended to be exhaustive or limiting. Many modifications and variations will be apparent to those of ordinary skill in the art. The embodiments were chosen and described in order to explain principles and practical application, and to enable others of ordinary skill in the art to understand the disclosure for various embodiments with various modifications as are suited to the particular use contemplated.

What is claimed is:

1. A system for reducing the volume of waste comprising:

a frame;

a hingable lid attached to the frame, the lid having a latch;

a first sensor coupled to the frame to detect if the lid is in a closed position;

a trash volume reduction chamber connected to the frame, the trash volume reduction chamber having at least a first shaft and a second shaft, each shaft having an axis and a plurality of knives projecting radially from their axis, the knives on the first shaft and the second shaft spaced such that from the knives on the first shaft interleave with the knives of the second shaft to define passages that to allow trash particles of a predetermined size to fall out of the volume reduction chamber, the frame to hold the reduction chamber above a mobile curb-side receptacle;

a motor coupled to the frame;

a power transmission system to couple the motor to the first shaft and second shaft a controller to reverse a direction of rotation of the first shaft and second shaft; and the first shaft and second shaft disposed in the trash volume reduction chamber, the motor to rotate the first shaft in counter relationship to the second shaft where the waste is fragmented reducing a volume of the waste.

2. The system of claim 1, further comprising an agent dispersal system coupled to the frame to disperse an agent.

3. The system of claim 1, further comprising flexible flaps to guide the fragmented waste into the mobile curb-side receptacle.

4. The system of claim 1, further comprising adjustable legs secured to the frame to hold the reduction chamber above the mobile curb-side receptacle.

5. The system of claim 1, further comprising a control system to prevent activation of the motor if the lid is not in the closed position.

6. The system of claim 5, further comprising a sensor proximate to the control chamber to detect the presence of material in the chamber and to facilitate activation of the motor if the material is detected.

7. The system of claim 1 further comprising a second sensor to detect an overload condition and to control the motor according to the overload condition.

8. The system of claim 1, wherein the knives are rectangular in shape.

9. The system of claim 1, wherein the knives attached to the first shaft interleave with the knives of the second shaft.

10. The system of claim 1, further comprising a third shaft counter rotating in relationship to the first shaft.

11. The system of claim 1, further comprising a hub coupled to the first shaft and at least one hammer coupled to the hub.

12. The system of claim 11, wherein the knives are placed on the first and second shafts to allow the hammer to pass in opposite directions in close proximity to an adjacent shaft.

13. The system of claim 12 wherein the knives are co located at a particular position on the first shaft.

14. The system of claim 12 wherein the first and second shafts are propelled by a continuous loop power transmission means that engages the motor, the first shaft and the second shaft.

* * * * *